US005636603A

United States Patent [19]

Nakamura et al.

[11] Patent Number: 5,636,603

[45] Date of Patent: Jun. 10, 1997

[54] APPARATUS FOR DETECTING VALVE LIFTING CHARACTERISTIC OF CAM SHAFT ASSEMBLY FOR USE IN INTERNAL COMBUSTION ENGINE

[75] Inventors: Makoto Nakamura, Zushi; Shinichi Takemura, Fujisawa; Akira Hidaka, Atsugi, all of Japan

[73] Assignees: Nissan Motor Co., Ltd.; Unisia Jecs Corporation, both of Kanagawa, Japan

[21] Appl. No.: 621,918

[22] Filed: Mar. 26, 1996

[30] Foreign Application Priority Data

Mar. 27, 1995 [JP] Japan ..... 7-068284

[51] Int. Cl.[6] ..... F01L 13/00

[52] U.S. Cl. ..... 123/90.17; 123/90.31

[58] Field of Search ..... 123/90.15, 90.16, 123/90.17, 90.22, 90.27, 90.31; 74/567, 568 R

[56] References Cited

U.S. PATENT DOCUMENTS

| | | | |
|---|---|---|---|
| 5,271,360 | 12/1993 | Kano et al. | 123/90.17 |
| 5,333,579 | 8/1994 | Hara et al. | 123/90.17 |
| 5,363,817 | 11/1994 | Ikeda et al. | 123/90.17 |
| 5,365,896 | 11/1994 | Hara et al. | 123/90.17 |
| 5,494,009 | 2/1996 | Yamada et al. | 123/90.17 |
| 5,501,186 | 3/1996 | Hara et al. | 123/90.17 |
| 5,553,573 | 9/1996 | Hara et al. | 123/90.17 |

FOREIGN PATENT DOCUMENTS

| | | |
|---|---|---|
| 57-198306 | 6/1982 | Japan . |
| 62-21409 | 2/1987 | Japan . |
| 2-308911 | 12/1990 | Japan . |
| 3-75730 | 12/1991 | Japan . |
| 5-202718 | 8/1993 | Japan . |

*Primary Examiner*—Weilun Lo

*Attorney, Agent, or Firm*—Lowe, Price, Leblanc & Becker

[57] ABSTRACT

In an apparatus for detecting a valve lifting characteristic of a cam shaft assembly for use in a multi-cylinder internal combustion engine with a cylinder head to control opening and closure of cylinder valves, a sensor which is so arranged and constructed as to detect the valve lifting characteristic of the cam shaft assembly is disposed on an end of at least one of either a first eccentric control cam or a second eccentric control cam, both of the first and second eccentric cams being rotatably coupled with an intermediate member supported by a support so as to vary an eccentricity of the intermediate member to a shaft axis of a driven shaft according to a rotation position of the first eccentric control cam, the first and second eccentric control cam, the intermediate member, the support, and the driven shaft constituting the cam shaft assembly. In an embodiment, a potentiometer is attached onto an end of a control rod integrally formed with the first eccentric control cam, the other end of the control rod being attached with a hydraulic actuator to rotate the control rod according to an engine driving condition.

7 Claims, 7 Drawing Sheets

APPARATUS FOR DETECTING VALVE LIFTING CHARACTERISTIC OF CAM SHAFT ASSEMBLY FOR USE IN INTERNAL COMBUSTION ENGINE

BACKGROUND OF THE INVENTION

The present invention relates to an apparatus for detecting a valve lifting characteristic of a cam shaft assembly for use in an internal combustion engine.

A U.S. Pat. No. 5,365,896 issued on Nov. 22, 1994 exemplifies a cam shaft assembly for use in an internal combustion engine which variably controls opens and closures of intake and/or exhaust valves of each engine cylinder.

SUMMARY OF THE INVENTION

It is an object of the present invention to provide an apparatus for detecting a valve lifting characteristic of the cam shaft assembly for use in an internal combustion engine which can accurately and reliably detect the valve lifting characteristic of the cam shaft assembly from an eccentricity of an intermediate member constituting the cam shaft assembly with no introduction of problems of an apparatus durability and strength (rigidity) and with easiness in layout of the detecting apparatus in the cam shaft assembly.

According to one aspect of the present invention, there is provided with an apparatus for detecting a valve lifting characteristic of a cam shaft assembly for use in a multi-cylinder internal combustion engine with a cylinder head to control opening and closure of cylinder valves, said cam shaft assembly comprising:

a) a driven shaft rotatable about its shaft axis (X) in synchronization with an engine revolution;

b) a cam rotatable relative to said driven shaft, said cam being in a drive connection to said driven shaft and said cam having; a plurality of cam lobes, each lobe being contacted with a corresponding one of the cylinder valves so as to drive the corresponding one of the cylinder valves to open and close; a support; an intermediate member supported in said support for rotation about an axis thereof so as to enable an eccentric rotation thereof with respect to said shaft axis; a first coupling between said drive member and said intermediate member at a first position spaced apart from said shaft axis; a second coupling between said intermediate member and said cam angularly spaced apart from said first position with respect to said shaft axis, said first and second couplings being spaced from said shaft axis so that they are at varying distanced from the axis (Y) of the intermediate member during operation and each of said first and second couplings having a movable connection with said intermediate member to permit variation in its distance from said axis of said intermediate member;

c) means for holding said support for movement within a plane perpendicular to said shaft axis; and d) means for varying an eccentricity of said intermediate member with respect to said shaft axis, said varying means including a control rod for rotation about an axis thereof, said control rod having a first eccentric control cam rotatably coupled with a first hole of said support and said holding means including pivot means including a second hole and a second eccentric control cam rotatably coupled with said second hole so that the movement of said support is allowed to follow said first eccentric control cam, said apparatus comprising: a sensor attached onto at least one of either an end of said control rod or second eccentric control cam and so arranged and constructed as to detect a rotation position of said first eccentric control cam or said second control cam, thus detecting the valve lifting characteristic of said cam shaft assembly.

According to another aspect of the present invention, in a cam shaft assembly for use in an internal combustion engine with a cylinder head to control opening and closure of intake valves arranged for each engine cylinder comprising:

a) a driven shaft rotatable about its shaft axis (X) in synchronization with an engine revolution;

b) a cam rotatable relative to said driven shaft, said cam being in a drive connection to said driven shaft and said cam having; a plurality of cam lobes, each lobe being contacted with a corresponding one of the cylinder valves so as to drive the corresponding one of the cylinder valves to open and close; a support; an intermediate member supported in said support for rotation about an axis thereof so as to enable an eccentric rotation thereof with respect to said shaft axis; a first coupling between said drive member and said intermediate member at a first position spaced apart from said shaft axis; a second coupling between said intermediate member and said cam angularly spaced apart from said first position with respect to said shaft axis, said first and second couplings being spaced from said shaft axis so that they are at varying distanced from the axis (Y) of the intermediate member daring operation and each of said first and second couplings having a movable connection with said intermediate member to permit variation in its distance from said axis of said intermediate member;

c) means for holding said support for movement within a plane perpendicular to said shaft axis; and d) means for varying an eccentricity of said intermediate member with respect to said shaft axis, said varying means including a control rod for rotation about an axis thereof, said control rod having a first eccentric control cam rotatably coupled with a first hole of said support and said holding means including pivot means including a second hole and a second eccentric control cam rotatably coupled with said second hole so that the movement of said support is allowed to follow said first eccentric control cam, a sensor which is so arranged and constructed as to detect a valve lifting characteristic of the cam assembly for the intake valves being arranged on an end of either the first eccentric control cam or the second eccentric control cam to detect a rotation position of at least one of either the first or second eccentric control cam.

BEST MODE FOR CARRYING OUT THE INVENTION

Reference will hereinafter be made to the drawings in order to facilitate a better understanding the present invention.

Figure 1:
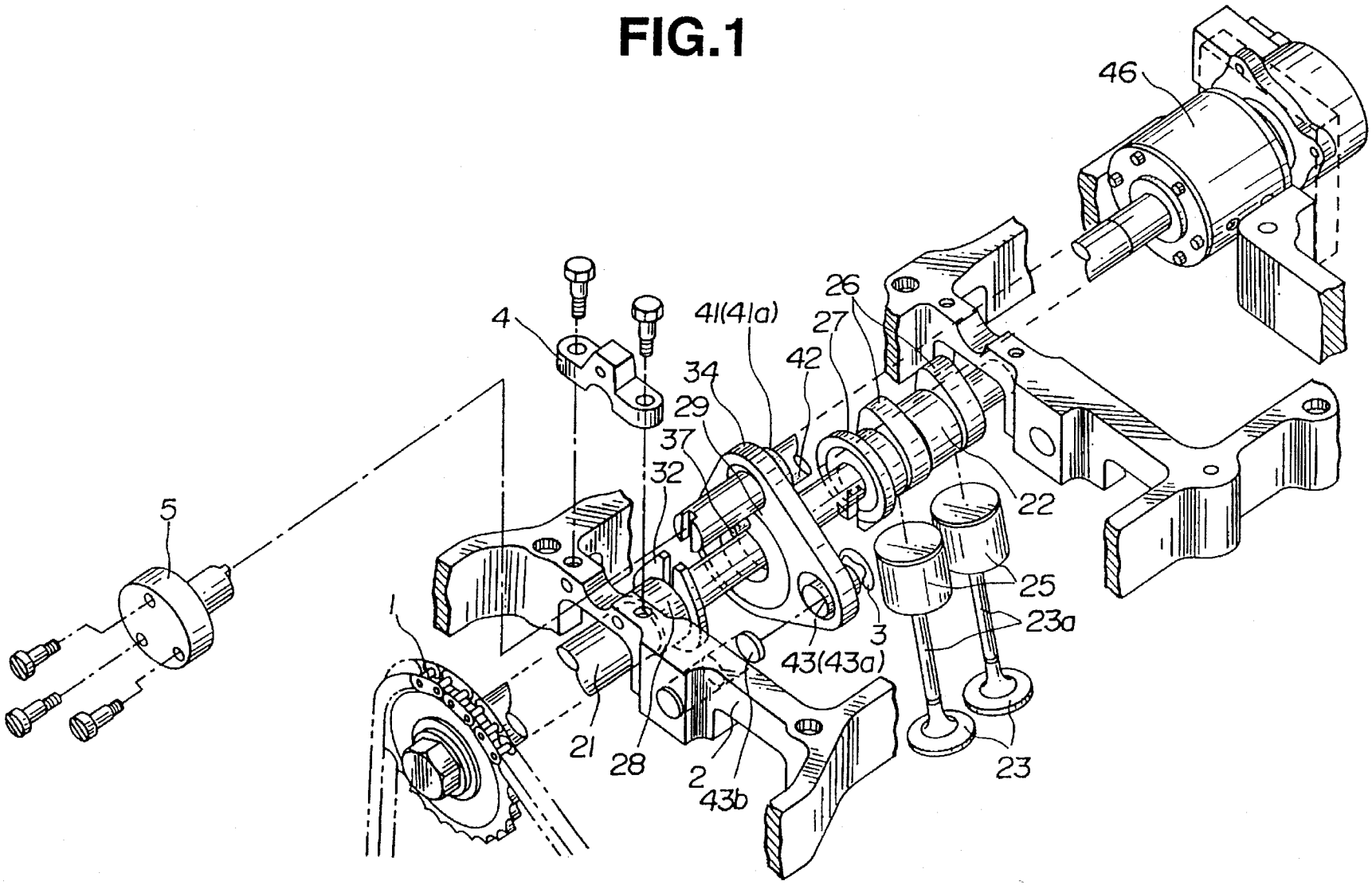
FIG. 1 is an exploded perspective view of an apparatus for detecting a valve lifting characteristic of a cam shaft assembly for use in an internal combustion engine in a preferred embodiment according to the present invention.

FIG. 1 shows a preferred embodiment of an apparatus for detecting a valve lifting characteristic of a cam shaft assembly for use in a multi-cylinder internal combustion engine with a cylinder head to control opening and closure of intake valves for one of a plurality of engine cylinders.

In FIG. 1, a hollow cylindrical driven shaft 21 is extended over a cylinder head of the engine. The driven shaft 21 to which a rotating force from an engine crankshaft (not shown) is transmitted via a timing chain 1 is rotated about its shaft axis (X) in synchronization with an engine crankshaft revolution. A hollow cylindrical cam or cam shaft 22 is so arranged on the driven shaft so as to enclose an outer periphery of the driven shaft 21 with a constant clearance and mounted on the same shaft axis of the driven shaft 21

The driven shaft 21 is extended in a forward/rearward direction (longitudinal direction) of the engine. The cam 22 is so arranged and constructed as to be divided into one for each cylinder. The cam 22 is rotatably supported on a cam bearing (not shown) located on an upper end of the cylinder head (not shown).

As shown in FIG. 1, a plurality of cam lobs 26 are integrally extended from predetermined positions of an outer periphery of the cam 22 so as to open the corresponding intake valves 23 of the one of the cylinders via a valve lifter 25 against spring forces of valve springs (not shown) extended along valve stems 23*a*.

A driven collar (flange) 27 is disposed on an end of the divided cam 22. A sleeve 28 and annular disc (or called intermediate member) 29 are disposed between an intermediate end of the driven shaft 21 and the driven collar 27.

Figure 2:
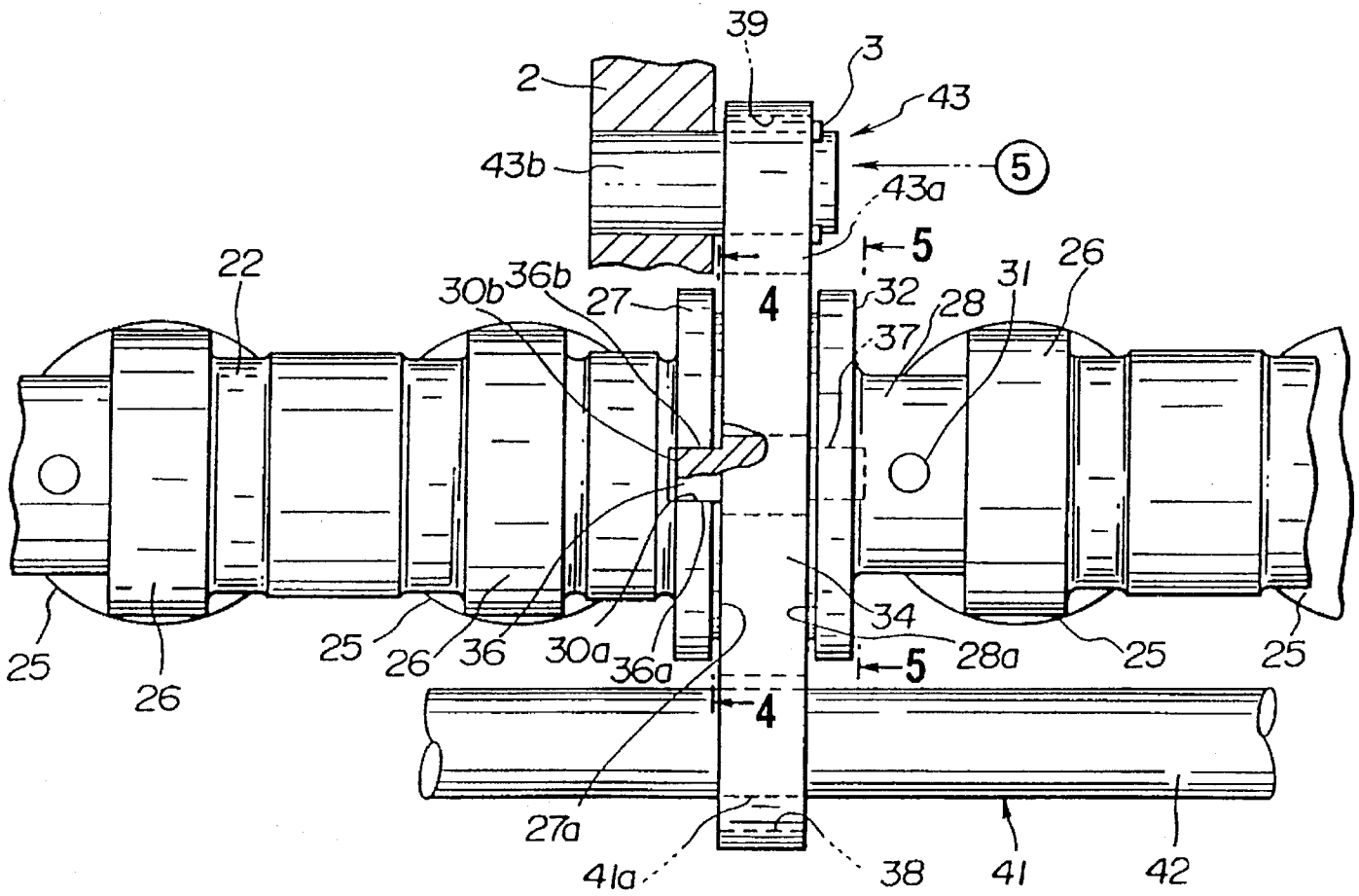
FIG. 2 is a top view of an essential part of the cam shaft assembly for use in an internal combustion engine to which the present invention is applicable.

FIG. 2 generally shows a top view of an essential part of the cam shaft assembly shown in FIG. 1.

Figure 3:
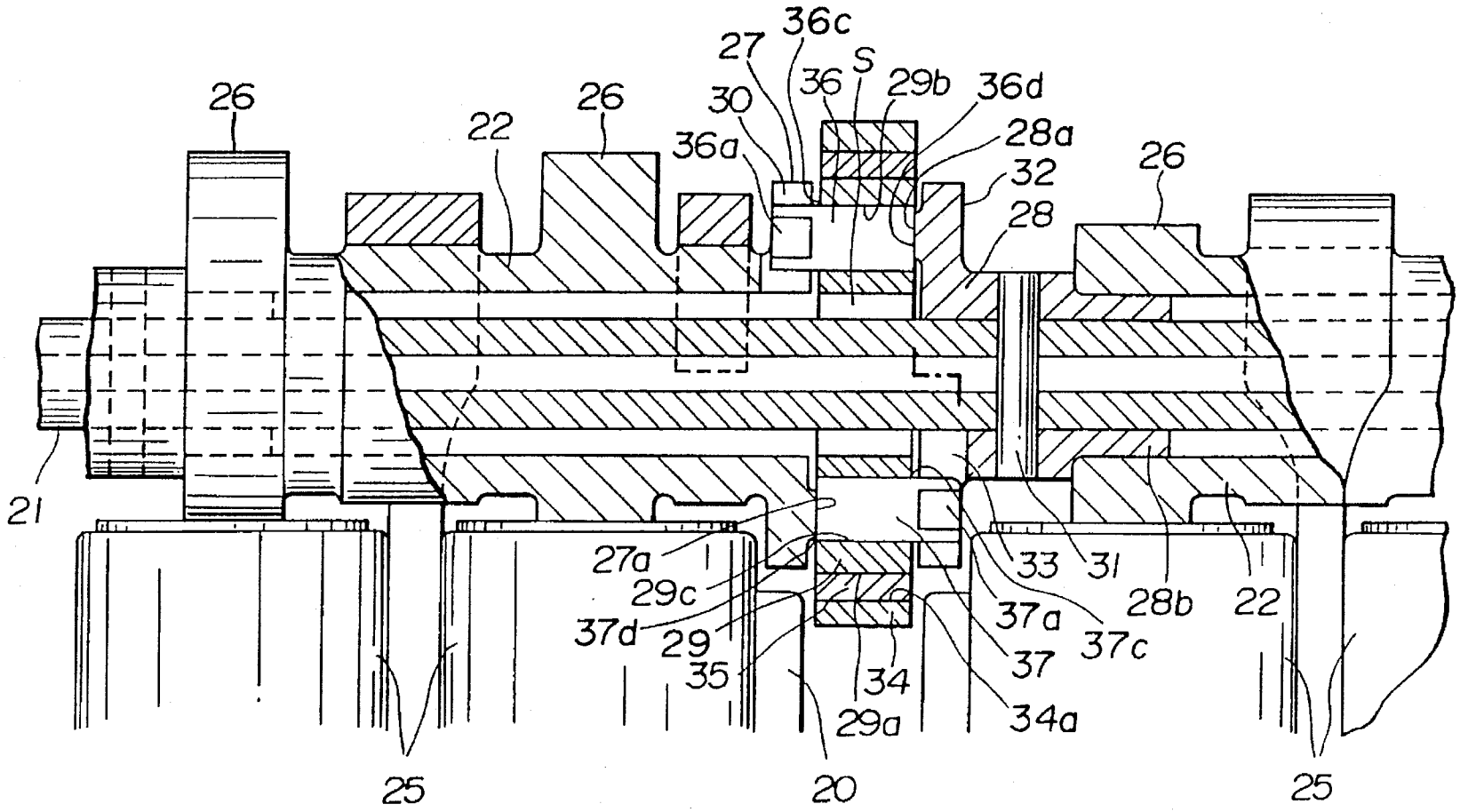
FIG. 3 is a partially cut out side cross sectional view of the essential part of the cam shaft assembly shown in FIGS. 1 and 2.

FIG. 3 generally shows a side cross sectional view of the cam shaft assembly shown in FIG. 1

Figure 4:
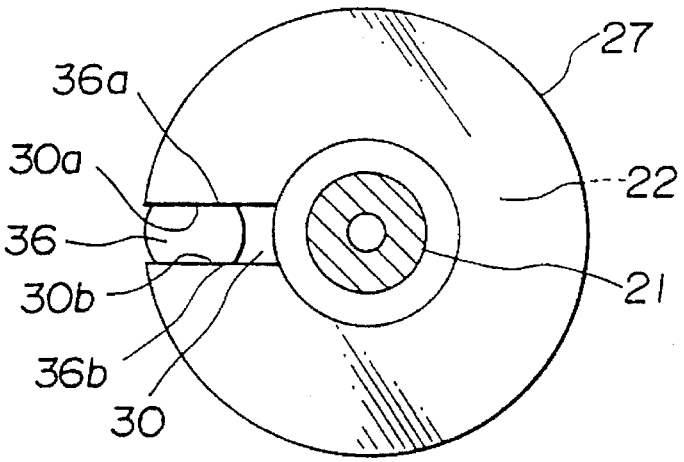
FIG. 4 is a cross sectional view of the cam shaft assembly cut away along a line of 4 of FIG. 2.

FIG. 4 shows a cross sectional view of the cam shaft assembly cut away along the line 4 of FIG. 2.

Figure 5:
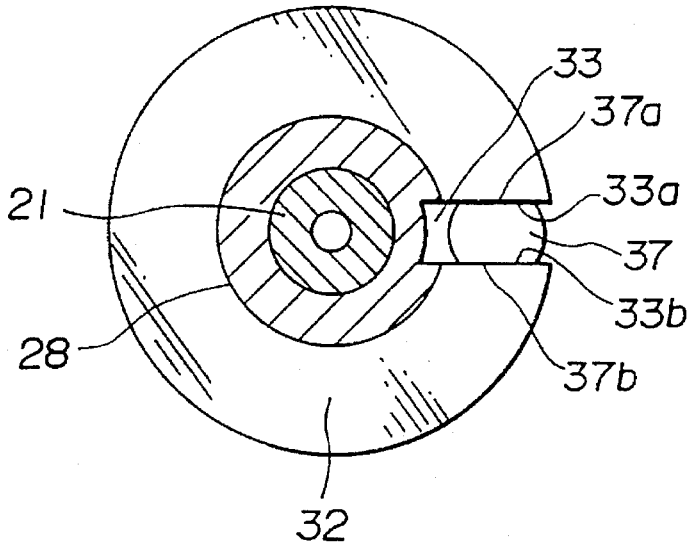
FIG. 5 is a cross sectional view of the cam shaft assembly cut away along a line of 5 of FIG. 2.

FIG. 5 shows a cross sectional view of the cam shaft assembly cut away along the line 5 of FIG. 2.

The driven collar 27 is formed with an elongated engagement groove 30 (or called slit) of a rectangular shape in cross section extended in a radial direction thereof from its hollow portion and is provided with a flange surface 27*a* slidably contacted with one side surface of the annular disc (intermediate member) 29.

A smaller radius end of the sleeve 28 is rotatably inserted into the divided end of the cam 22, fitted into the outer periphery of the driven shaft 21, and linked to the driven shaft 21 via a linkage pin penetrated through the sleeve 28 in its diameter direction. A flange 32 formed on another end of the sleeve 28 is faced against the driven collar 27 located at the end of the cam 22, formed with an elongated engagement groove 33 of a rectangular shape in cross section extended in the radial direction of the flange 32, and is provided with a flange surface 28*a* slidably contacted with another side surface of the intermediate member 29. The engagement groove 33 is placed 180° opposite to the engagement groove 30 of the flange portion (driven collar) 27 located at the end of the cam 22.

The intermediate member 29 is approximately formed in a ring shape, its inner diameter being generally the same inner diameter of the cam 22 and being formed with an annular clearance S (as shown in FIG. 3) against the outer peripheral surface of the driven shaft 21. An outer peripheral surface 29*a* of the intermediate member 29 is rotatably supported on an inner peripheral so surface of the support 24 via an annular bearing In addition, holes 29*b* and 29*c* are formed in the intermediate member 29 at upper and lower positions 180° opposite to each other in the diameter direction. A pair of pins 36 and 37 are fitted into the respective holes 29*b* and 29*c* so as to engage with the engagement grooves 30 and 33. Each pin 36 and 37 is projected from the corresponding outer surface of the intermediate member 29 in a mutually opposite direction of the shaft axis of the cam 22. A base portion of a cylindrical surface is rotatably fitted into the corresponding one of the holes 29*b* and 29*c*. Two flat surfaces 36*a* and 36*b* are formed on a tip end of the corresponding pin 36 projected from the surface of the intermediate member 29 and are brought in contact with inner surfaces 30*a* and 30*b* of the engagement groove 30 faced against each other, as shown in FIG. 4. Two flat surface 37*a* and 37*b* are formed on a tip of the corresponding pin 37 projected from the surface of the intermediate member 29 and are brought in contact with inner surfaces 33*a* and 33*b* of the engagement groove 33 faced against each other, as shown in FIG. 5.

The positioning of the pins 36 and 37 in the axial direction of the cam 22 is carried out as follows: for a projected direction of each pin 36 and 37, mutual contacts are made between stepped portions 36*c* and 37*c* generated between the cylindrical surfaces of the pins 36 and 37 and respective two flat surfaces 36*a* and 36*b* and 37*a* and 37*b* and flange surfaces 27*a* and 28*a* and for a retracted position of each pin 36 and 37, mutual contacts are made between the base surfaces 36*d* and 37*d* of the pins 36 and 37 penetrated through the holes 29*b* and 29*c* and flange surfaces 28*a* and 27*a*.

Next, the support 34 is approximately formed in a triangular shape as shown in FIG. 1 and is provided with a circular opening 34*a* within which the intermediate member 29 is supported. First circular hole and second circular bole 38 and 39 are formed at two apices of the triangular shape support 34 so as to receive first eccentric control cam 41 and second eccentric control cam 43 as described below.

Figure 6A:
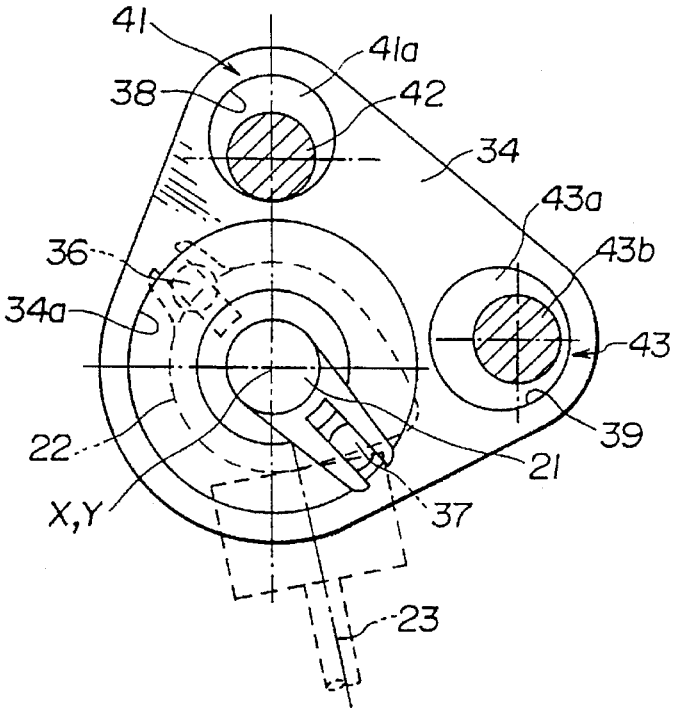
FIG. 6A is an explanatory view of a support and first and second eccentric control cams in the first embodiment shown in FIGS. 1 to 5 in a concentric state.
Figure 6B:
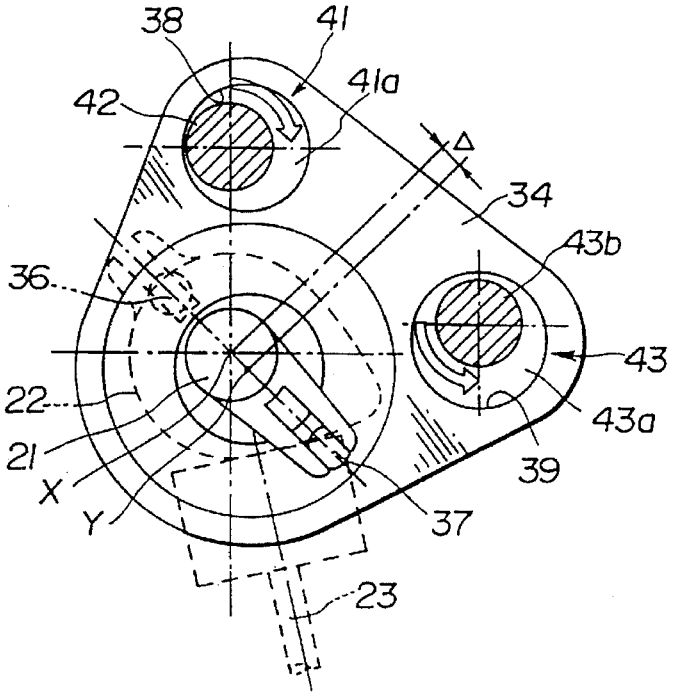
FIG. 6B is an explanatory view of the support and first and second eccentric control cams in the first embodiment shown in FIGS. 1 to 5 in an eccentric state.

FIGS. 6A and 6B show the arrangement of the support 34, intermediate member 29, and driven shaft 21.

A circular cam portion 41*a* of the first eccentric control cam 41 is pivotally fitted in the first hole 38 of the support 34 and a circular cam portion 43*a* of the second eccentric control cam 43 is pivotally fitted into the second hole 39.

The second eccentric cam 43 includes: a) a cylindrical shaft portion 43*b*; and b) the circular cam portion 43*a* which is eccentric to the cylindrical shaft portion 43*b* by a predetermined eccentricity, both of the shaft portion 43*b* and the circular cam portion 43*a* being integrally formed. The circular can portion 43*a* is inserted into the second hole 39 and grasped by means of a snap ring 3 so as to avoid pulling out of the cam portion 43*a* from the second hole 39. On the other hand, the shaft portion 43*b* is fitted into a hole formed on a side rail 2 as typically shown in FIG. 1.

The first eccentric control cam 41 includes: a control rod 42 extended over the plurality of cylinders along the longitudinal direction of the engine; and a plurality of circular cam portions 41*a*, each cam portion 41*a* being disposed over a corresponding; one of the engine cylinders, both of the control rod 42 and the circular cam portions 41*a* being integratedly fixed and eccentric to each other by the predetermined eccentricity.

The circular cam 41*a* of each cylinder eccentric to tile axis of the control rod 42 at a predetermined angular position of the control rod 42. The first eccentric control cam 42 is rotatably supported the side rail 2 via a cam bracket 4, as typically shown in FIG. 1. A hydraulic actuator 46 of a rotary type is attached onto an end of the control rod 42 placed at a rear end of the engine. It is noted that a potentiometer 5 is attached onto the other end of the control rod 42 so as to detect a rotation position of the control rod 42, i.e., a rotational phase of the circular cam portion 41*a* with respect to a reference concentric position ( shown in FIG. 6A).

It is also noted that a diameter of each circular cam portion 41*a* of the first eccentric control cam 41 is the same as that of each circular cam portion 43*a* of the second eccentric control cam 43 and its eccentricity of each circular cam portion 41*a* to the control rod 42 is the same as that of each circular cam portion 43*a* of the second eccentric control cam 43 to the shaft portion 43*b*, in the embodiment. However, both eccentricities on the circular cam portion 41*a* and on the circular cam portion 43*b* may be different from each other.

Figure 7:
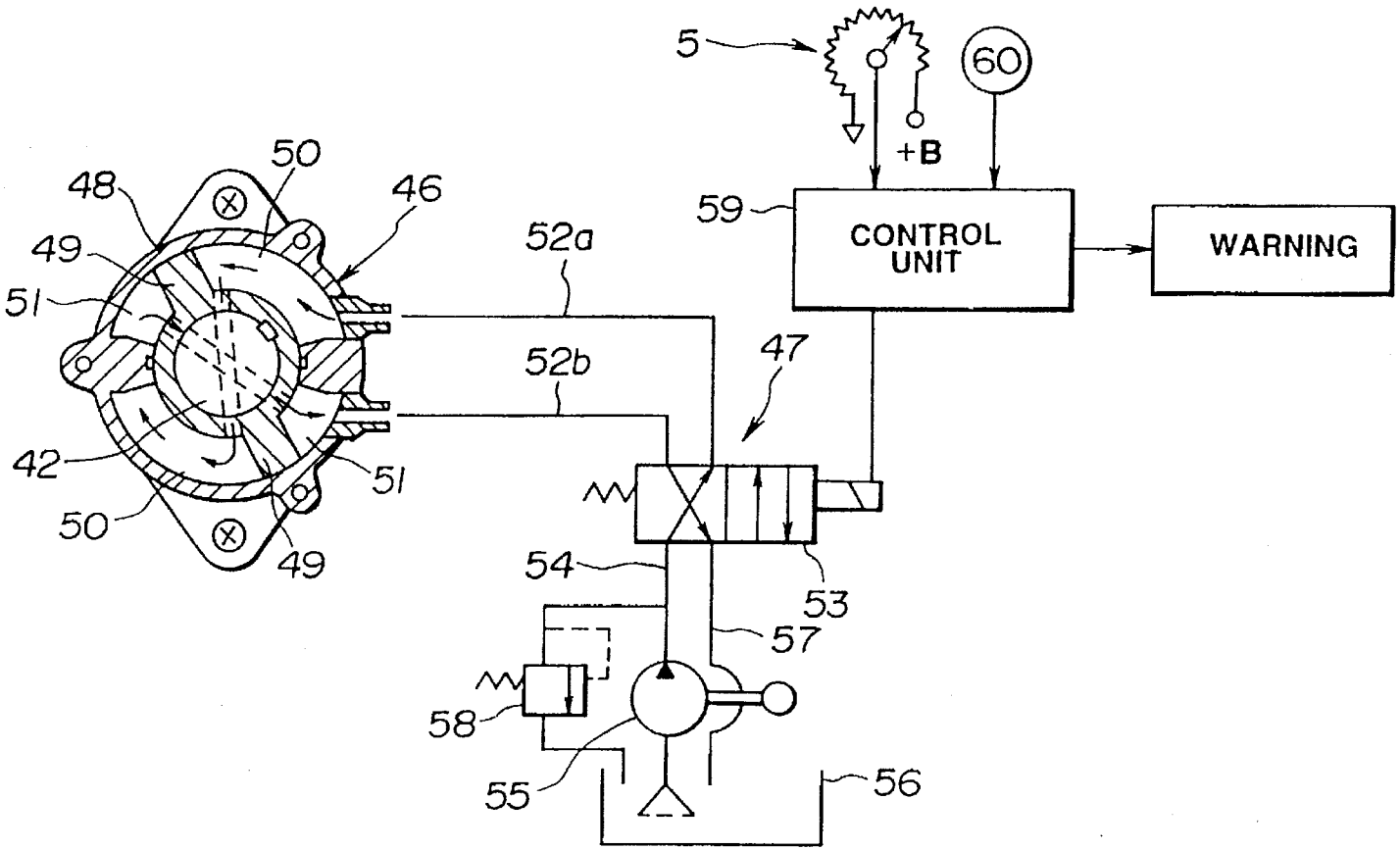
FIG. 7 is a hydraulic and electric circuit diagram of a drive mechanism in the first embodiment shown in FIGS. 1 to 6B.

FIG. 7 shows the hydraulic actuator 46 and a hydraulic circuit to control a phase of the actuator 46.

The hydraulic actuator 46 includes: a cylindrical housing 48; a rotary vane 49 of two blades rotatably disposed within the housing 48; a plurality of first oil chambers 50 and a plurality of second oil chambers 51 each being partitioned by means of the rotary vane 49 and placed on a diagonal line. The rotary vane 49 is linked to the control cam rod 42.

The hydraulic circuit, connected to the actuator 46, includes: first and second oil lines 52*a* and 52*b* which supply and exhaust an oil pressure to and from the first and second oil chambers 52*a* and 52*b*; a four-port, two-position type electromagnetic control valve 53 installed on ends of the first and second oil lines 52*a* and 52*b*; an oil pump 55 disposed on an upstream end of an oil main gallery 54; a drain line 57 used to return the working oil within a drainage 56 by properly communicating with each oil supply line 52*a* and 52*b*; and a relief valve (pressure regulator valve) 58 which controls an oil draining pressure of the oil pump 55 under a constant pressure.

The electromagnetic valve 53 is controlled by means of a control unit 59 which determines a current engine driving condition on tile basis of an output signal from an engine driving condition sensor 60, for example, engine revolution speed sensor or intake airflow meter.

Thus, the rotation position of the hydraulic actuator 46 is continuously varied according to a control signal derived from the control unit 59 indicating the determined current engine driving condition.

Next, an operation of the preferred embodiment of the detecting apparatus for detecting the valve lifting characteristic of the cam shaft assembly will be described below with chief reference to FIGS. 8A and 8B.

First, when the engine falls in a predetermined driving condition, e.g., an engine high-speed region, the rotation position of the first eccentric control cam 41 is controlled via the actuator 46 as shown in FIG. 6A At this time, the axial center of the intermediate member 29 and that of the driven shaft 21 are coincident with each other. In this case, no rotational phase difference occurs between the intermediate member 29 and tile driven shaft 21. In addition, since the axis center of the cam 22 and the center X of the intermediate member 29 are coincident with each other, the rotational phase difference between the intermediate member 29 and cam 22 does not occur.

Thus, the three of the driven shaft 21, intermediate member 29, and cam shaft 22 are synchronously rotated at equal speeds via the pins 36 and 37. Consequently, the valve lifting characteristic as denoted by a solid line of FIG. 8A can be achieved.

On the other hand, when the engine falls in an engine low-speed region, the rotational position of the first eccentric control cam 41 is controlled through the actuator 46 as shown in FIG. 6B.

At this time, the axis center Y of intermediate member 29 is made eccentric to the axis center X of the driven shaft 21 by an eccentricity denoted by a of FIG. 6B.

At this time, an unequal rotation of the intermediate member 29 is resulted such that an angular velocity of the intermediate member 29 is varied.

Figures 8A, 8B:
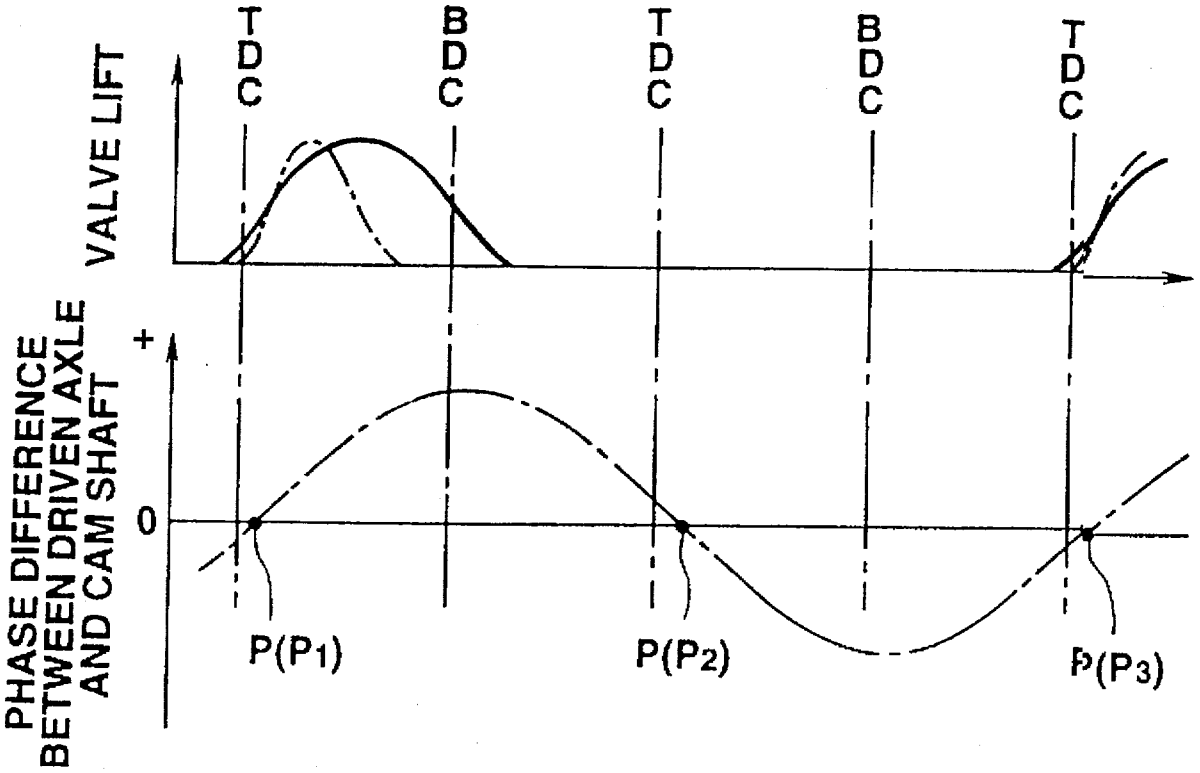
FIG. 8A is a characteristic graph representing a valve lifting characteristic of the cam shaft assembly for use in the internal combustion engine shown in FIGS. 1 to 6B.
FIG. 8B is a characteristic graph representing a rotation phase difference between a driven shaft and a cam in the case of the cam shaft assembly in the preferred embodiment shown in FIGS. 1 to 6B.

Consequently, as denoted by a dot-and-dash line of FIG. 8B, a rotational phase difference between the driven shaft 21 and cam 22 occurs according to tile degree of the eccentricity a. In addition, the same phase points (P, $P(P_1)$, $P(P_2)$, $P(P_3)$ are present in a midway through maximum and minimum points of the rotational phase difference.

It is noted that, in the characteristic graph shown in FIG. 8B, the phase difference in the direction such that the phase of the cam 22 is advanced relatively with respect to that of the driven shaft 21 is positive and the phase difference in the direction such that the phase of the cam 22 is retarded relatively with respect to that of the driven shaft 21 is negative.

A valve open timing of each intake valve placed at a region (a region before the point $P_1$ and a region between the points $P_2$ and $P_3$) is retarded along with the phase difference. On the contrary, a valve closure timing of each intake valve 23 placed at a region (a region between the points $P_1$ and $P_2$) is advanced along with the phase difference. Hence, the valve lifting characteristic as denoted by a dot-and-dash line of FIG. 8A can be achieved so that an operational (dwell) angle of each intake valve 23 is made smaller.

FIG. 6B shows a state of the intermediate member 29 and the support 34 in which the first eccentric control cam 41 is rotated 90° in a clockwise direction from the position of the first eccentric control cam 41 Shown in FIG. 6A. As shown in FIG. 6B, a continuous variation of the rotational position of the first eccentric control cam 41 can cause the continuous variation of the eccentricity Δ so that the valve lifting characteristic can continuously be varied. On the other hand, if the rotational direction of the first eccentric control cam 41 is reversed in the counterclockwise direction, the phase difference in the opposite direction to that shown in FIG. 8B can be achieved.

It is noted that the second eccentric control cam 43 which serves to support the support 34 together with the first eccentric control cam 41 is rotated to follow the rotation of the first eccentric control cam 41.

The rotational position of the first eccentric control cam 41 is detected by means of the potentiometer 5 in the embodiment. An output voltage of the potentiometer 5 which corresponds to the rotational position of the first eccentric; control cam 41 is inputted into the control unit 59. The control unit 59 determines the actual valve lifting characteristic from the output voltage of the potentiometer 5.

That is to say, the rotational direction of the first eccentric control cam 41 corresponds to the eccentricity of the support 34 which corresponds to a final valve lifting characteristic of the cam shaft assembly. Hence, if the rotational position of the first eccentric control cam 41 is detected, the actual valve lifting characteristic can accurately be determined.

The control unit 59 compares the detected valve lifting characteristic through the potentiometer 5 with a target valve lifting characteristic stored in a memory as a target value so that an abnormality in the drive mechanism including the actuator 46 and hydraulic circuit shown in FIG. 7 can be detected. If the abnormality of the actuator 46 and/or hydraulic circuit is detected, the control unit 59 issues a warning signal to a warning apparatus such as a warning lamp (or buzzer).

Since, in the embodiment, the first eccentric control cam 41 itself is not a member which moves at high speeds along with the opens and closures of the cylinder valves, the apparatus for detecting the valve lifting characteristic is superior in the durability.

In addition, since the detecting apparatus is placed at a position spaced apart from the intake valves 23 and the cam 22, both of which are moved at high speeds, no restriction of layout of the detecting apparatus can be received.

In addition, in the embodiment, the first eccentric control cam 41 which is integrated over the plurality of engine cylinders can serve to control the valve lifting characteristic for each cylinder and the rotational position thereof can be detected by means of the single potentiometer 5. It is not necessary to install the detecting apparatus for each cylinder so that the structure of the detecting apparatus in the cam shaft assembly can be simplified.

Especially, since the hydraulic actuator 46 is disposed on the end of the first eccentric control cam 42 and the potentiometer 5 is disposed on the other end of the first eccentric control cam 42, the layout of the detecting apparatus can be simplified.

Since the hydraulic actuator 46 is disposed at a position of the rear end of the engine, the restriction of the layout of the detecting apparatus with the timing chain 1 can be avoided.

Although, in the embodiment, the rotational position of the first eccentric control cam 41 is detected by means of the potentiometer 5, the same sensor may alternatively be disposed on the second eccentric control cam 43 as denoted by a phantom line of FIG. 2 so as to detect the rotational position of the second eccentric control cam 43.

Although, in the embodiment, the detecting apparatus is installed in the cam shaft assembly for the intake valves, the detecting apparatus according to the present invention is also applicable to the cam shaft assembly for exhaust valves.

Furthermore, with the cam shaft assemblies for the intake valves and for the exhaust valves juxtaposed, their intermediate members 29 can be made eccentric by means of an integrated support 34. In this alternative case, the single first eccentric control cam can variably control both valve lifting characteristics of the intake and exhaust valves and the detection of the valve lifting characteristics can be made with the single potentiometer.

It is noted that TDC and BDC shown in FIGS. 8A and 8B denote a piston Top Dead Center and a piston Bottom Dead Center, respectively.

It is finally noted that the structure of the cam shaft assembly described in the embodiment is exemplified by a U.S. Pat. No. 5,365,898, the disclosure of which is herein incorporated by reference.

What is claimed is:

1. An apparatus for detecting a valve lifting characteristic of a cam shaft assembly for use in a multi-cylinder internal combustion engine with a cylinder head to control opening and closure of cylinder valves, said cam shaft assembly comprising:

a) a driven shaft rotatable about its shaft axis (X) in synchronization with an engine crankshaft revolution;

b) a cam means rotatable relative to said driven shaft, said cam means being in a drive connection to said driven shaft, said cam means having a plurality of cam lobes, each lobe being contacted with a corresponding one Of the cylinder valves so as to drive the corresponding one of the cylinder valves to open and close; a support; an intermediate member supported in said support for rotation about an axis thereof so as to enable an eccentric rotation thereof with respect to said shaft axis; a first coupling between said driven shaft and said intermediate member at a first position spaced apart from said shaft axis; a second coupling between said intermediate member and said cam means angularly spaced apart from said first position with respective said shaft axis, said first and second couplings being spaced from said shaft axis so that they are at varying distanced from the axis (Y) of the intermediate member during operation and each of said first and second couplings having a movable connection with said intermediate member to permit variation in its distance from said axis of said intermediate member;

c) means for holding said support for movement within a plane perpendicular to said shaft axis; and d) means for varying an eccentricity of said intermediate member with respect to said shaft axis, said varying means including a control rod for rotation about an axis thereof, said control rod having a first eccentric control cam rotatably coupled with a first hole of said support, said holding means including pivot means including a second hole and a second eccentric control cam rotatably coupled with said second hole so that the movement of said support is allowed to follow said first eccentric: control cam, said apparatus comprising: a sensor attached onto at least one of either an end of said control rod or second eccentric control cam and so arranged and constructed as to detect a rotational position of said first eccentric control cam or said second control cam, thus detecting the valve lifting characteristic of said cam shaft assembly.

2. An apparatus for detecting a valve lifting characteristic of a cam shaft assembly for use in a multi-cylinder internal combustion engine with a cylinder head to control opening and closure of cylinder valves, as claimed in claim 1, which further comprises a drive mechanism attached onto another end of said control rod for operatively controlling the rotation position of said first eccentric control cam and wherein said sensor is attached onto the end of said control pod to detect the rotation position of the first eccentric control cam.

3. An apparatus for detecting a valve lifting characteristic of a cam shaft assembly for use in a multi-cylinder internal combustion engine with a cylinder head to control opening and closure of cylinder valves, as claimed in claim 2, wherein said drive mechanism comprises: another sensor installed within the engine and so arranged and constructed as to detect an engine driving condition; a control unit receiving a signal indicative of the engine driving condition from the other sensor and for outputting a control signal according to the engine driving condition; and a hydraulic actuator receiving the control signal from said control unit for actuating said control rod to rotate through the rotational position of said first eccentric control cam according to the control signal.

4. An apparatus for detecting a valve lifting characteristic of a cam shaft assembly for use in a multi-cylinder internal combustion engine with a cylinder head to control opening and closure of cylinder valves, as claimed in claim 3, wherein said sensor comprises a potentiometer whose output voltage is proportional to the rotation position of the first eccentric control cam.

5. An apparatus for detecting a valve lifting characteristic of a cam shaft assembly for use in a multi-cylinder internal combustion engine with a cylinder head to control opening and closure of cylinder valves, as claimed in claim 4, wherein said control rod is extended wholly over a plurality of engine cylinders.

6. An apparatus for detecting a valve lifting characteristic of a cam shaft assembly for use in a multi-cylinder internal combustion engine with a cylinder head to control opening and closure of cylinder valves, as claimed in claim 5, wherein said cylinder valves comprise intake valves for each engine cylinder.

7. In a cam shaft assembly for use in an internal combustion engine with a cylinder head to control opening and closure of intake valves arranged for each engine cylinder comprising:

a) a driven shaft rotatable about its shaft axis (X) in synchronization with an engine crankshaft revolution;

b) a cam means rotatable relative to said driven shaft, said cam means being in a drive connection to said driven shaft, said cam means having a plurality of cam lobes, each lobe being contacted with a corresponding one of the cylinder valves so as to drive the corresponding one of the cylinder valves to open and close; a support; an intermediate member supported in said support for rotation about an axis thereof so as to enable an eccentric rotation thereof with respect to said shaft axis; a first coupling between said driven shaft and said intermediate member at a first position spaced apart from said shaft axis; a second coupling between said intermediate member and said cam means angularly spaced apart from said first position with respect to said shaft axis, said first and second couplings being spaced from said shaft axis so that they are at varying distanced from the axis (Y) of the intermediate member during operation and each of said first and second couplings having a movable connection with said intermediate member to permit variation in its distance from said axis of said intermediate member;

c) means for holding said support for movement within a plane perpendicular to said shaft axis; and d) means for varying an eccentricity of said intermediate member with respect to said shaft axis, said varying means including a control rod for rotation about an axis thereof, said control rod having a first eccentric control cam rotatably coupled with a first hole of said support, said holding means including pivot means including a second hole and a second eccentric control cam rotatably coupled with said second hole so that the movement of said support is allowed to follow said first eccentric control cam, a sensor which is so arranged and constructed as to detect a valve lifting characteristic of the cam assembly for the intake valves being arranged on an end of either the first eccentric control cam or the second eccentric control cam to detect a rotational position of at least one off either the first or second eccentric control cam.

* * * * *